US005881531A

United States Patent [19]

Bitner

[11] Patent Number: 5,881,531

[45] Date of Patent: Mar. 16, 1999

[54] COMPRESSION WEIGHT FOR USE IN LAYING FLOORING

[76] Inventor: Garry W. Bitner, 8304 Farmington Ct., Austin, Tex. 78736

[21] Appl. No.: 867,889

[22] Filed: Jun. 3, 1997

[51] Int. Cl.[6] ..... E04B 1/00

[52] U.S. Cl. ..... 52/749.1; 16/110 R; 81/489; 404/118

[58] Field of Search ..... 52/749.1, 749.11, 52/749.13, 749.14, 749.15; 33/403; 81/46, 487, 489; 16/110 R, DIG. 24, 114 R, 403, 404, 121, 111 R, DIG. 3; 404/118; 269/1, 904, 909

[56] References Cited

U.S. PATENT DOCUMENTS

| | | | |
|---|---|---|---|
| 1,763,066 | 6/1930 | Rooney | 16/114 R |
| 3,162,881 | 12/1964 | Negwer | 403/85 X |
| 4,583,343 | 4/1986 | Camp | 52/749.11 |
| 5,184,446 | 2/1993 | Gustavsen | 52/749.1 X |
| 5,224,309 | 7/1993 | Bodell | 52/749.1 X |
| 5,652,999 | 8/1997 | Jarvis | 16/110 R |
| 5,687,448 | 11/1997 | Dye | 403/87 X |

*Primary Examiner*—Carl D. Friedman
*Assistant Examiner*—Beth A. Aubrey
*Attorney, Agent, or Firm*—Baker & Botts, L.L.P.

[57] ABSTRACT

A compression weight (10) for use in laying flooring is disclosed. The compression weight (10) includes a body (12) and a handle (14). The body (12) has an upper surface and a lower surface where the lower surface is substantially planar. The body (12) is constructed from an epoxy resin material. The handle (14) is coupled to the upper surface of the body (12) to provide a gripping surface. The lower surface of the body (12) can thereby be applied to flooring to compress the flooring while being laid.

9 Claims, 1 Drawing Sheet

COMPRESSION WEIGHT FOR USE IN LAYING FLOORING

TECHNICAL FIELD OF THE INVENTION

This invention relates in general to the field of flooring tools, and more particularly to a compression weight for use in laying flooring.

BACKGROUND OF THE INVENTION

One aspect of laying flooring, such as carpet and vinyl, is that seams are formed between adjacent pieces of flooring. It is important to the quality, durability and esthetic appeal of the flooring that seams be relatively hidden and difficult to discern. For example, when carpet is laid, seam joining tools can be used to mix fibers from the adjacent pieces of carpet to hide the position of the seam.

When forming a seam, glue is used along the seam line to affix the flooring to the underlying surface. For example, hot melt glue in the form of seaming tape is often used along the seam line. In this case, the seaming tape is laid out along the underlying floor surface at the interface between two pieces of flooring. A seaming iron is then slowly passed over the seaming tape to melt lines of hot melt glue on the seaming tape. Once the hot melt glue is melted, the flooring pieces are placed together over the melted glue to form the seam. After the glue dries, the flooring is fixed in place, and the seam is formed. In the case of carpet, a seam joining tool can then be used to help hide the position of the seam.

In the seam forming process, it is important for the flooring to be properly set when the glue dries. Careless work can result in poor adhesion and in the flooring not being flush with the underlying surface. Bubbles can be particularly troublesome with vinyl flooring. Consequently, although not generally commercially available, various home-made weights have been used to compress the flooring during the period of time after the seam has been formed and while the glue is drying. This compression both smooths the glue to form a planar surface as well as produces better adhesion between the flooring and the underlying surface.

Conventional compression weights used for this purpose include tool box trays weighted with tools, large pieces of wood, and pieces of steel covered with tape. These and other conventional compression weights suffer from a number of problems. For example, tool box trays can leave marks on the flooring due to the color of the trays or due to rusting. Similarly, pieces of steel can leave rust marks on the flooring. Duct tape has been used in an effort to cover the surfaces and avoid this problem. However, the duct tape can cause additional problems as well as eventually becoming worn and ineffective. Further, conventional weights such as wood and steel must be relatively large to be effective. The size and bulk of these weights make them unwieldy and difficult to transport.

SUMMARY OF THE INVENTION

In accordance with the present invention, a compression weight used in laying flooring is provided that provides significant advantages of conventional compression weights.

In accordance with one aspect of the present invention, a compression weight for use in laying flooring is disclosed. The compression weight includes a body and a handle. The body has an upper surface and a lower surface where the lower surface is substantially planar. The body is constructed from an epoxy resin material. The handle is coupled to the upper surface of the body to provide a gripping surface. The lower surface of the body can thereby be applied to flooring to compress the flooring while being laid.

A technical advantage of the present invention is the construction of a compression weight from epoxy resin counter top material. The density and nonstaining nature of the material produces a compression weight that is heavy enough to be effective without being too large and bulky and that does not leave marks on the flooring when used. Further, the compression weight provides a uniform weight distribution to better produce a consistent seam.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein.

DETAILED DESCRIPTION OF THE INVENTION

Figure 1:
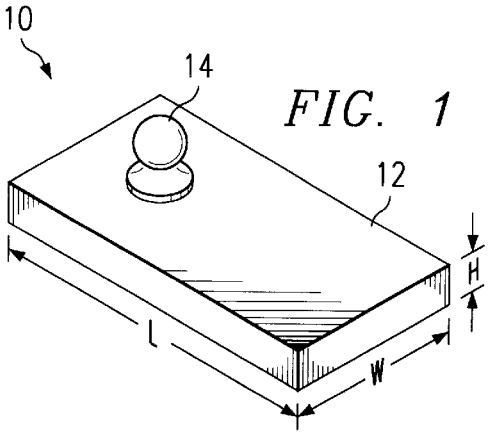
FIG. 1 is a perspective view of one embodiment of a compression weight constructed according to the teachings of the present invention.

FIG. 1 is a perspective view of one embodiment of a compression weight, indicated generally at 10, constructed according to the teachings of the present invention. Compression weight 10 comprises a body 12 and a handle 14. Body 12 has an upper surface and a lower surface where the lower surface is substantially planar. In the embodiment of FIG. 1, body 12 is constructed from epoxy resin counter top material cut to a length of twenty inches, a width of ten inches and a height of one inch. Other sizes can also be used, but this size has been found to provide both sufficient weight and surface area as well as ease of portability. In the embodiment of FIG. 1, handle 14 is a wooden ball type knob affixed to the upper surface of body 12 to provide a gripping surface. It should be understood that other forms of handles can also be used to provide a gripping surface.

The epoxy resin counter top material used to construct body 12 is preferably a baked mixture of epoxy resin that is available from LABORATORY TOPS, INC. located in Taylor, Tex. This material is relatively dense having a density of approximately 0.0765 pounds per cubic inch. Further, this material is relatively impervious to numerous acids and other solvents and can generally be easily cleaned of contaminating substances. In particular, this material is nonstaining to carpet, vinyl and other flooring materials. Other materials having approximately the same or higher density and having similar nonstaining characteristics could also be used within the teachings of the present invention.

Figure 2:
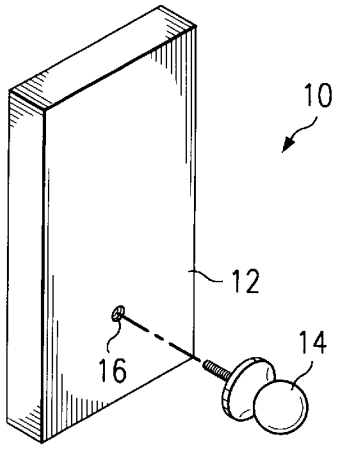
FIG. 2 is an exploded view of the compression weight FIG. 1.

FIG. 2 is an exploded view of compression weight 10 of FIG. 1. As shown, handle 14 can be coupled to body 12 by insertion of a connection feature of handle 14 into a hole, indicated generally at 16, drilled in body 12. The connection feature of handle 14 can be a screw, rod or other extension of handle 14. The connection feature can be affixed to body 12 using a binding substance such as glue or epoxy. One commercially available substance that can be used is LIQUID STEEL.

One process for manufacturing compression weight 10 of the present invention involves obtaining excess scrap counter top material from a manufacturer of epoxy resin counter tops, such as LABORATORY TOPS. The scrap material preferably has a thickness between ¾ inch and one inch. This scrap material can then be cut into separate pieces of approximately twenty inches in length and ten inches in width. Some variation in these measurements is acceptable as the tolerance is relatively large within which compression weight 10 can still perform its function. The cut pieces are then drilled for the placement of a knob to provide a handle for the compression weight. A screw extending from the knob is inserted into the drilled hole and affixed using LIQUID STEEL epoxy. It should be understood that other manufacturing methods and components could also be used within the teachings of the present invention.

Figure 3:
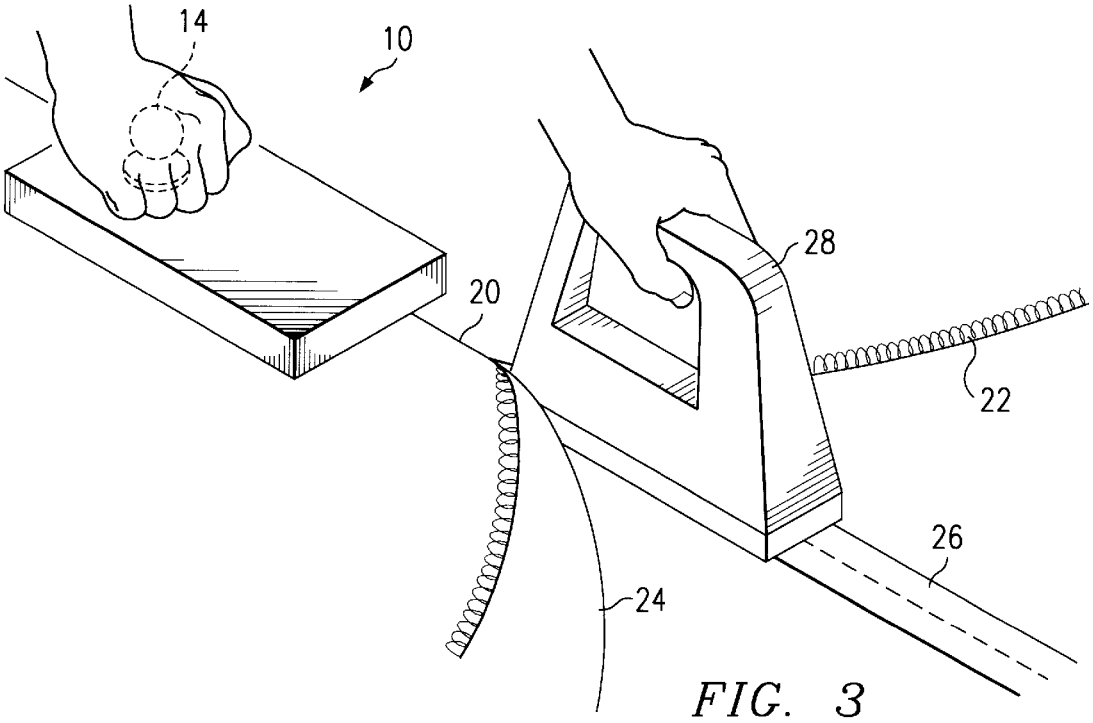
FIG. 3 is a diagram of the use of the compression weight of the present invention in the laying of flooring.

FIG. 3 is a diagram of the use of compression weight 10 of the present invention in the laying of flooring. As shown, the embodiment of FIG. 3 involves the use of compression weight 10 in forming a seam 20 between a first piece of carpet 22 and a second piece of carpet 24. A strip of seaming tape 26 is laid along seam 20 and includes strips of hot melt glue. A seaming iron 28 is then used to heat and melt the strips of hot melt glue on seaming tape 26. Once the hot melt glue is melted, the edges of first piece of carpet 22 and second piece of carpet 24 are placed together to form seam 20. Compression weight 10 is then used to apply pressure to the newly formed seam 20. Compression weight operates to hold down carpet 22 and 24 to allow better affixation of carpet 22 and 24 to the underlying floor surface when the hot melt glue dries. Further, compression weight 10 operates to smooth the hot melt glue to insure an even distribution and avoid bubbles or ripples in carpet 22 and 24. Compression weight 10 can be used in a similar manner in the laying of vinyl flooring where bubbles in the vinyl can particularly be a problem.

Compression weight 10 provides significant advantages in the floor laying process due to its density and nonstaining properties. The density of the compression weight allows it to be heavy enough to be effective without being too large and bulky. The nonstaining properties of compression weight 10 allows it to be used without leaving marks on the flooring (which marks would necessitate replacement of the flooring). The compression weight also provides a uniform weight distribution to better produce a consistent seam.

Although the present invention has been described in detail, it should be understood that various changes, substitutions and alterations can be made hereto without departing from the spirit and scope of the invention as defined by the appended claims.

What is claimed is:

1. A compression weight for use in laying flooring, comprising:

a body having an upper surface and a lower surface, where the lower surface is substantially planar, and the body is constructed from an epoxy resin material having a density of approximately 0.0765 pounds per cubic inch; and a handle coupled to the upper surface of the body to provide a gripping surface;

such that the lower surface of the body can be applied to flooring to compress the flooring while being laid.

2. The compression weight of claim 1, wherein the epoxy resin material comprises epoxy resin counter top material.

3. The compression weight of claim 2, wherein the epoxy resin material has a density of approximately 0.0765 pounds per cubic inch.

4. The compression weight of claim 2, wherein the epoxy resin counter top material is salvaged from scrap material.

5. The compression weight of claim 1, wherein the body is approximately one inch in height.

6. The compression weight of claim 5, wherein the body is approximately twenty inches in length and ten inches in width.

7. The compression weight of claim 1, wherein the handle comprises a wooden knob.

8. The compression weight of claim 7, wherein the handle has a screw extension, and the handle is coupled to the body by inserting the screw extension into a hole drilled in the upper surface of the body.

9. The compression weight of claim 6, wherein the handle is coupled to the body using epoxy to affix the screw extension in the hole.

* * * * *